US012522987B2

(12) United States Patent
Smieja et al.

(10) Patent No.: US 12,522,987 B2
(45) Date of Patent: Jan. 13, 2026

(54) DUST MITIGATION FOR DEPTH AND SPEED APPLICATIONS

(71) Applicant: Caterpillar Paving Products Inc., Brooklyn Park, MN (US)

(72) Inventors: Jameson Michael Smieja, Mound, MN (US); Travis D. McClung, Las Vegas, NV (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 321 days.

(21) Appl. No.: 18/119,346

(22) Filed: Mar. 9, 2023

(65) Prior Publication Data

US 2024/0301635 A1 Sep. 12, 2024

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01)

(58) Field of Classification Search
CPC ... E01C 23/088; E01C 23/127; E01C 2301/50
See application file for complete search history.

(56) References Cited

U.S. PATENT DOCUMENTS

| | | | | |
|---|---|---|---|---|
| 7,896,258 | B2 | 3/2011 | Hoisington et al. | |
| 9,371,618 | B2 | 6/2016 | Killion et al. | |
| 10,370,802 | B1 | 8/2019 | Hogan et al. | |
| 10,407,848 | B2 | 9/2019 | Hogan et al. | |
| 2004/0036346 | A1* | 2/2004 | Johannes Klaasse | B08B 17/00 299/39.2 |
| 2017/0356143 | A1* | 12/2017 | Pellevoisin | E01C 23/088 |
| 2020/0002902 | A1* | 1/2020 | Hogan | E01C 23/07 |
| 2020/0150669 | A1* | 5/2020 | Lacaze | G05D 1/646 |
| 2021/0131047 | A1* | 5/2021 | Hirman | E01C 23/127 |
| 2023/0066089 | A1* | 3/2023 | Fanning | B01D 46/0043 |
| 2023/0349112 | A1* | 11/2023 | Sturos | B05B 1/202 |

FOREIGN PATENT DOCUMENTS

| | | |
|---|---|---|
| CN | 105544365 | 5/2016 |
| DE | 4235359 C1 | 10/1993 |
| DE | 102021118686 A1 | 10/2022 |
| WO | 2015103908 | 7/2015 |

* cited by examiner

*Primary Examiner* — Carib A Oquendo

(57) ABSTRACT

A work machine for roadwork can include a frame, a power source, and a milling rotor operatively connected to the power source and the frame. Examples can also include a dust mitigation system having a controller. The controller can be configured to control the dust mitigation system based on a target dust mitigation level and a milling parameter of the work machine.

17 Claims, 3 Drawing Sheets

DUST MITIGATION FOR DEPTH AND SPEED APPLICATIONS

TECHNICAL FIELD

This disclosure relates to a work machine. More specifically, this disclosure relates to dust mitigation for depth and speed applications.

BACKGROUND

Asphalt, concrete, or cement-surfaced roadways are built to facilitate vehicular travel. Depending upon usage density, base conditions, temperature variation, moisture variation, or physical age, the surface of the roadways eventually becomes misshapen, non-planar, unable to support wheel loads, or otherwise unsuitable for vehicular traffic. To rehabilitate the roadways for continued vehicular use, spent asphalt, concrete, or cement is removed in preparation for resurfacing.

Cold planers, sometimes also referred to as road mills or scarifiers, are machines that typically include a frame propelled by tracked drive units. The frame supports an engine, an operator's station, and a milling rotor. The milling rotor, fitted with cutting tools, is rotated through a suitable interface by the engine to break up the surface of the roadway. The broken-up roadway material is deposited by the milling rotor onto a conveyor, or series of conveyors, that transport the material away from the machine and to a nearby haul vehicle for transportation away from the job site.

Dust is an unpleasant result of many roadwork constructions. For example, during the milling of a road, much dust and smoke is generated and can create an unpleasant environment for the operation of the milling work machine. The dust may make it difficult for the operators of the work machines to navigate the machine. The dust can make components (e.g., conveyor belts, milling bits, or other mechanical or electrical components of the work machines) wear more quickly. Moreover, the dust and smoke can create air quality issues for persons working in or around the work machine.

U.S. Pat. No. 9,371,618 to Caterpillar Paving Products, Inc., discusses a system and method for operating a cold planer. The method includes "a signal indicative of an operating state is used to determine an operating condition, which is a basis for deciding which spray banks from a plurality of spray banks should be activated. Thereafter, a water flow required to operate the spray banks is estimated and a pump command signal is determined. The pump is operated and a water pressure in a main manifold is monitored such that the pump is controlled using a closed-loop control scheme that receives the water pressure as feedback to maintain a desired water pressure within the main manifold."

SUMMARY OF THE INVENTION

In an example, a work machine for roadwork can include a frame, a power source, and a milling rotor operatively connected to the power source and the frame. Examples can also include a dust mitigation system having a controller. The controller can be configured to control the dust mitigation system based on a target dust mitigation level and a milling parameter of the work machine.

In another example, a method of dust mitigation for depth and speed applications of a work machine. The work machine can include a frame, a power source, a milling rotor operatively connected to the power source and the frame, and a dust mitigation system having a controller, the controller configured to control the dust mitigation system based on a target dust mitigation level and a milling parameter of the work machine. The method can include receiving, with the controller, the target dust mitigation level. The method can also include determining a removal rate of material removed by the work machine. The method can also include determining a flow rate of liquid within the dust mitigation system using the target dust mitigation level and removal rate of material removed by the work machine. The method can also include maintaining a ratio of the flow rate of liquid within the dust mitigation system and the removal rate of material removed for the target dust mitigation level.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various examples discussed in the present document.

DETAILED DESCRIPTION

Figure 1:
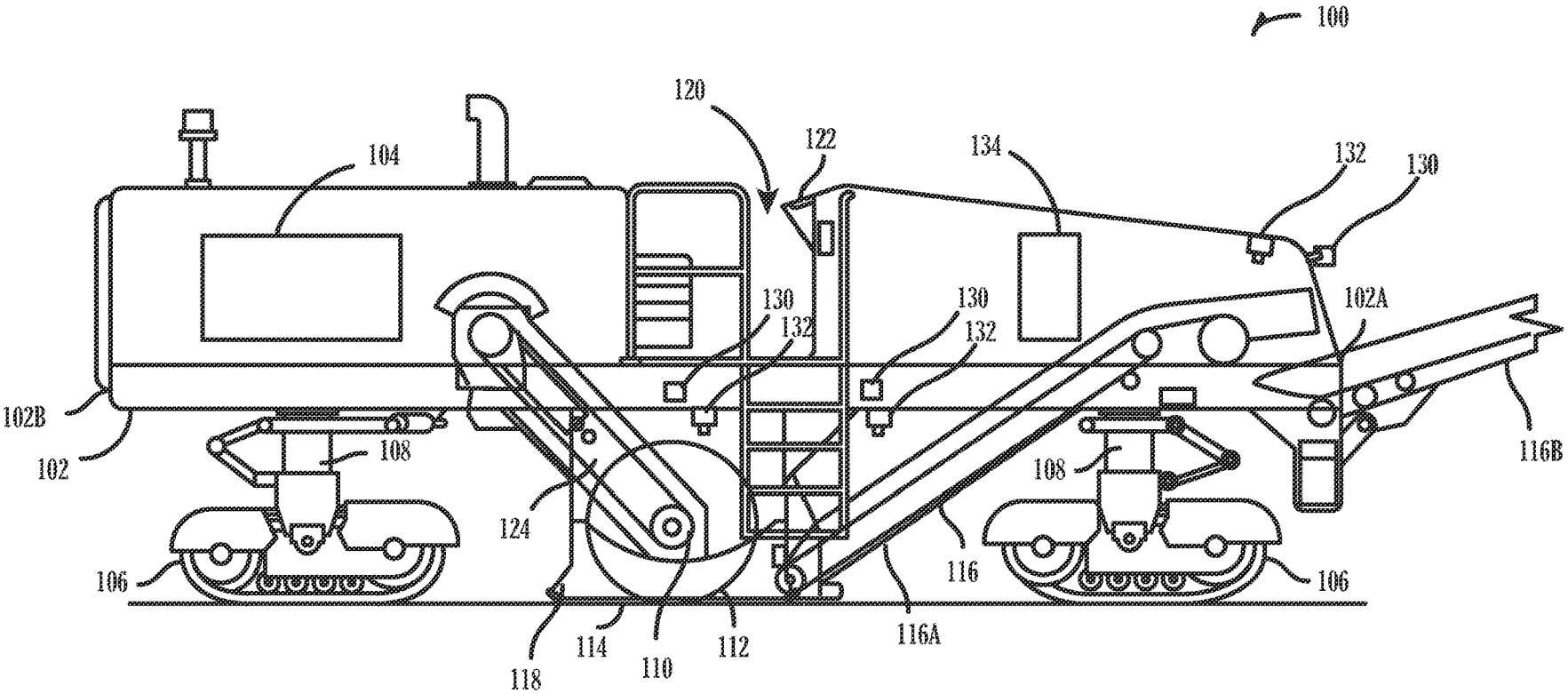
FIG. 1 illustrates a schematic side view, with some internal components visible, of an example of a work machine.

FIG. 1 illustrates a schematic side view of an example of a work machine 100. The work machine 100 can include a frame 102, a power source 104, a plurality of ground engaging units (hereinafter referred to as "ground-engaging units 106"), and a plurality of vertically movable legs (hereinafter referred to as "vertically-movable legs 108"). The power source 104 can be connected to the frame 102. The ground-engaging units 106 can be connected to the frame 102 by the vertically-movable legs 108. In the example of FIG. 1, the work machine 100 can be a cold planer. In another example, the work machine 100 can be any other machine used for roadwork.

The frame 102 can longitudinally extend between a first end 102A and a second end 102B. The power source 104 can be provided in any number of different forms including, but not limited to, internal combustion engines, electric motors, hybrid engines, or any power source used to power construction equipment. Power from the power source 104 can be transmitted to various components and systems of the work machine 100, such as the ground-engaging units 106 or a milling assembly 110.

The frame 102 can be supported by the ground-engaging units 106 via the vertically-movable legs 108. The ground-engaging units 106 can be any kind of ground-engaging device that allows the work machine 100 to move over a ground surface such as a paved road or a ground already processed by the work machine 100. For example, as shown in FIG. 1, the ground-engaging units 106 can be configured as track assemblies or crawlers. In other examples, the ground-engaging units 106 can be configured as wheels, such as inflatable or hard tires, or any other ground-engaging device used for navigating construction vehicles.

The ground-engaging units 106 can be configured to move the work machine 100 in forward and backward directions along the ground surface. The vertically-movable legs 108 can be configured to raise and lower the frame 102 relative to the ground-engaging units 106 and the ground. One or more of the vertically-movable legs 108 can be configured to rotate about their central axis to provide steering for the work machine 100.

The work machine 100 can include multiple ground-engaging units 106, for example, four: a front left ground-engaging unit, a front right ground-engaging unit, a rear left ground-engaging unit, and a rear right ground-engaging unit, each of which can be connected to vertically-movable legs 108, respectively. As shown in FIG. 1, the work machine 100 can include four of the ground-engaging units 106 and four of the vertically-movable legs 108, where two of the ground-engaging units 106 and two of the vertically-movable legs 108 are located further into the plane of FIG. 1 and so are not shown. However, in other examples, the work machine 100 can utilize fewer than four of the ground-engaging units 106, such as three. The present disclosure is not limited to any particular number of ground-engaging units or vertically-moveable legs.

The vertically-movable legs 108 can be provided to raise and lower the frame 102 to, for example, control a cutting depth of a milling rotor 112 and to accommodate the work machine 100 engaging obstacles on the ground.

The work machine 100 can include the milling assembly 110 connected to the frame 102. The milling assembly 110 can include a cylindrical milling rotor 112. The milling rotor 112 can be operatively connected to the power source 104. The milling rotor 112 can include a plurality of cutting tools (not shown in FIGS.) such as chisels, or milling bits disposed thereon the periphery of the milling rotor 112. The milling rotor 112 can be rotated about its center axis. As the milling rotor 112 rotates, the cutting tools can engage a work surface 114. The work surface 114 can be asphalt, concrete, or any other material used to make existing roadways, bridges, parking lots, or any other concrete, cement, asphalt, or any combination thereof. Moreover, as the milling rotor 112 engages the work surface 114, the cutting tools can remove layers of materials forming the work surface 114, such as hardened dirt, rock, or pavement. The spinning action of the milling rotor 112 and the cutting tools can transfer the material of the work surface 114 onto a conveyor system 116. The conveyor system 116 can remove the material from near the milling rotor 112 and carries the material away from the milling rotor 112 to be deposited in a receptacle. For example, the receptacle can be a box of a dump truck.

The work machine 100 can also include a pair of side plates (hereinafter referred to as "side plates 118"), only one of which is shown, the other being disposed further into the plane of FIG. 1. The side plates 118 can act as lateral covers to the milling assembly 110 and the milling rotor 112. Thus, the milling rotor 112 can be located between the side plates 118. The frame 102 and the side plates 118 can define a milling chamber 124. The milling chamber 124 can configured to prevent debris from flying outside of the frame 102 such that the milling chamber 124 contains the milling debris and dust.

The work machine 100 can further include an operator station or a platform 120 including a control panel or a human-machine interface (hereinafter referred to as "control panel 122") for inputting commands to the control system 200 for controlling the work machine 100, and for outputting information related to an operation of the work machine 100. As such, an operator of the work machine 100 can perform control and monitoring functions of the work machine 100 from the platform 120, such as by observing various data output by various sensors located on the work machine 100. Furthermore, the control panel 122 can include controls for operating the ground-engaging units 106 and the vertically-movable legs 108.

Figure 2:
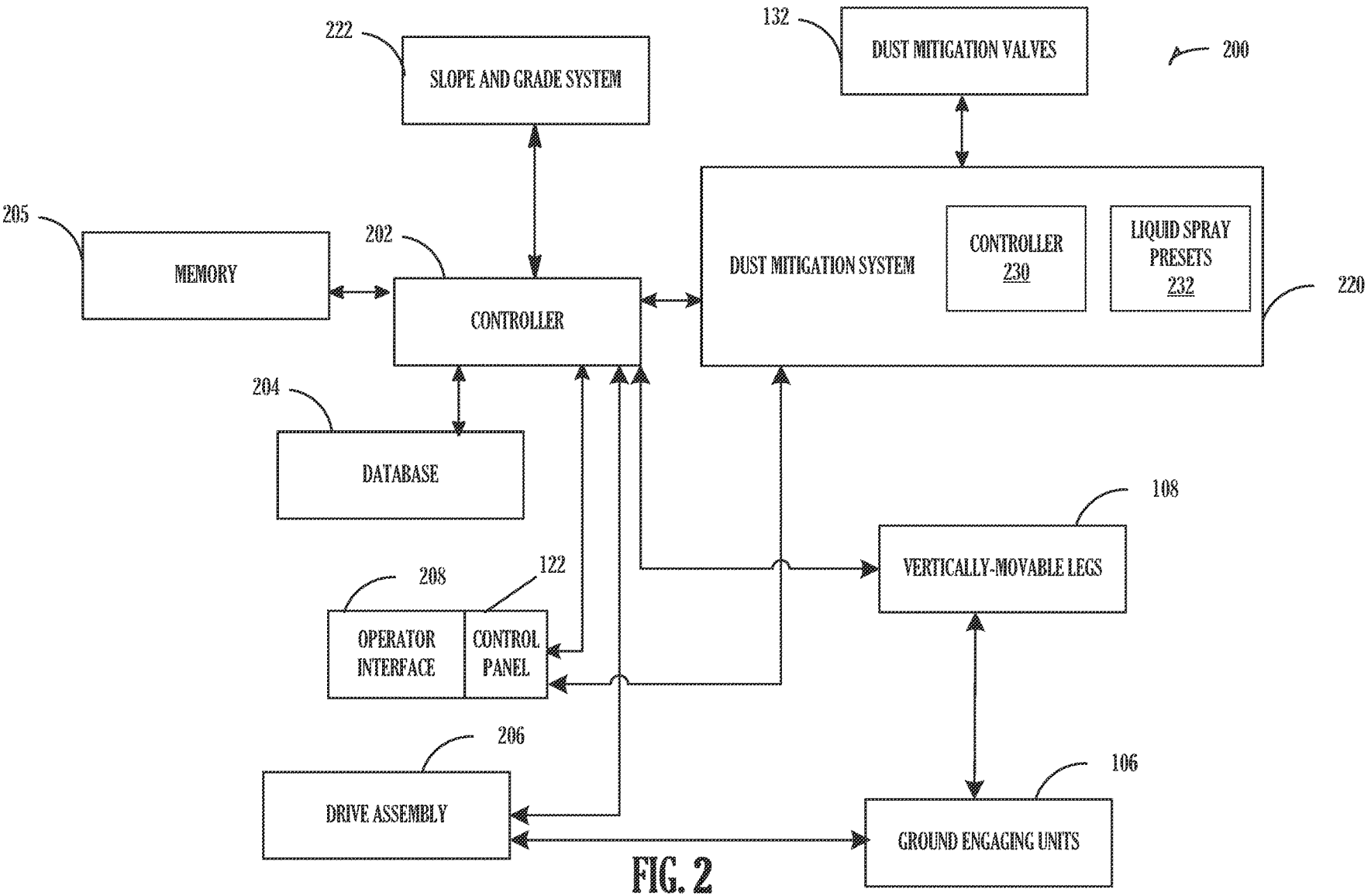
FIG. 2 illustrates a schematic diagram of a control system for a work machine.

The work machine 100 can include sensors that communicate to a control system 200 (FIG. 2). For example, the work machine 100 can include a sensor 130. As shown in FIG. 1, the sensor 130 can be installed on the frame 102. Here, the sensor 130 can be installed such that the sensor 130 can detect dust that escapes from the milling chamber 124. In such an example, the sensor 130 can detect dust escaping from the milling chamber 124 before the dust reaches the platform 120 and affects the operator's operation of the work machine 100. Moreover, the sensor 130 can detect dust before it spreads to other areas of the work machine 100 and to areas outside of the work machine 100. In examples, the sensor 130 can be a camera or an image sensor, an optical sensor, an infrared sensor, or any other kind of sensor that can be used to detect the presence of dust.

In another example, the sensor 130 can be attached to the frame 102 such that the sensor 130 can detect dust on the conveyor system 116. Here, the sensor 130 can detect dust escaping from the conveyor system 116 before the dust obstructs the operator's field of view and interferes with the operator's operation of the work machine 100. Moreover, the sensor 130 can detect dust before it spreads to other areas of the work machine 100 and to areas outside of the work machine 100.

In the example shown in FIG. 1, the work machine 100 includes the sensors 130 attached to the frame 102 near the milling chamber 124, the conveyor system 116, and the first end 102A. In another example, the work machine 100 can include just one such sensor 130 located at any one of the described positions and any other location that the sensor 130 can be mounted on the work machine 100.

The work machine 100 can also include one or more fluid spray nozzles or dust mitigation valves 132 through which a liquid can flow, each of the one or more dust mitigation valves 132 communicatively connected to the controller 202 of the dust mitigation system 220. In an example, the controller 230 of the dust mitigation system 220 can control each of the one or more dust mitigation valves 132 to change a resistance to flow through each of the one or more dust mitigation valves 132, respectively.

For example, the dust mitigation valve 132 can be attached to the frame 102 such that the dust mitigation valve 132 can supply a liquid within the milling chamber 124 to attenuate or decrease the dust within the milling chamber 124. Here, the dust mitigation valve 132 can supply the liquid to the milling rotor 112, the cutting tools, the work surface 114, or any combination thereof. Decreasing the dust within the milling chamber 124 can help prevent dust from escaping the milling chamber 124 and interfering with the operation of the work machine 100.

In examples, the conveyor system 116 can include a first segment 116A and a second segment 116B. In examples, the first segment 116A can be between the milling chamber 124 and the second segment 116B.

In another example, the dust mitigation valve 132 can be attached to the frame 102 near the first segment 116A of the conveyor system 116. Here, the dust mitigation valve 132 can be positioned such that the dust mitigation valve 132 can supply the liquid to the conveyor system 116 or the debris on the conveyor system 116 to mitigate dust around the conveyor system 116. Decreasing the dust near the conveyor system 116 can prevent dust from accumulating near the first segment 116A of the conveyor system 116 and escaping the work machine 100 and interfering with the operation of the work machine 100.

In yet another example, the dust mitigation valve 132 can be attached to the frame 102 near the first end 102A. Here, the dust mitigation valve 132 can be positioned such that the dust mitigation valve 132 can supply liquid to the second segment 116B of the conveyor system 116, the debris exiting the conveyor system 116 or a combination thereof. Decreasing dust near the first end 102A can prevent dust from accumulating near the second segment 116B of the conveyor system 116 and escaping the work machine 100 and interfering with the operation of the work machine 100.

As shown in FIG. 1, the work machine 100 can have the dust mitigation valve 132 mounted near the milling chamber 124, the first segment 116A of the conveyor system 116, and the second segment 116B of the conveyor system 116. In another example, the dust mitigation valve 132 can be mounted at any of the described positions, or at any other position on the work machine 100 to help mitigate dust around the work machine 100.

The work machine 100 can also include a liquid storage tank 134. The liquid storage tank 134 can be configured to supply liquid to each dust mitigation valve 132. For example, the liquid storage tank 134 can be fluidically connected to each dust mitigation valve 132. In an example, the liquid can be water. In another example, the liquid can be water, detergent, any other additive designed to help bind to dust particles and remove dust particles from the air, any combination thereof, or the like.

The work machine 100, as well as other exemplary road construction machines such as rotary mixers, can include further components not shown in the drawings, which are not described in further detail herein. In some examples, the work machine 100 may be a milling machine or a reclamation machine. In other examples, the work machine 100 may be any other work machine that generates dust while interacting with the work surface 114.

FIG. 2 illustrates a schematic diagram of the control system 200 for the work machine 100. The work machine 100 can be controlled by one or more embedded or integrated controllers (hereinafter referred to as "controller 202"). The controller 202 can include one or more processors, microprocessors, microcontrollers, electronic control modules (ECMs), electronic control units (ECUs), programmable logic controllers (PLCs), or any other suitable means for electronically controlling functionality of the work machine 100.

The controller 202 can be configured to operate according to a predetermined algorithm or set of instructions for controlling the work machine 100 based on various operating conditions of the work machine 100, such as can be determined from output of any of the various sensors. Such an algorithm or set of instructions can be stored in a database 204, can be read into an on-board memory of the controller 202, or preprogrammed onto a storage medium or memory accessible by the controller 202, for example, in the form of a floppy disk, hard drive, flash drive, optical medium, random access memory (RAM), read-only memory (ROM), or any other suitable computer-readable storage medium commonly used in the art (each referred to as a "database"), which can be in the form of a physical, non-transitory storage medium. In some examples, the controller 202 and associated hardware and stored instructions may be positioned on the work machine 100, while in other examples the controller 202 and the associated hardware and stored instructions may be positioned at an off-board location (remote location) relative to the work machine 100. In a further example, the controller 202 and associated hardware could be on-board work machine 100, and the stored instructions could be stored remotely (e.g., in 'the cloud'). The work machine 100 may also include a communication device (not shown) configured to enable the work machine 100 and, if onboard, controller 202, to communicate with one or more remote servers, processors, or control systems (e.g., 'the cloud') located remotely from the worksite at which the work machine 100 is being used. Such a communication device may also be configured to enable the work machine 100 to communicate with one or more electronic devices located at the worksite and/or located remote from the worksite.

The controller 202 can be in electrical communication with or connected to a drive assembly 206, or the like, and various other components, systems or sub-systems of the work machine 100. The drive assembly 206 can comprise an engine, a hydraulic motor, a hydraulic system including various pumps, reservoirs, actuators, or combinations thereof, among other elements (such as the power source 104 of FIG. 1). By way of such connection, the controller 202 can receive data pertaining to the current operating parameters of the work machine 100 from sensors, such as, the sensor 130, and the like. In response to such input, the controller 202 can perform various determinations and transmit output signals corresponding to the results of such determinations or corresponding to actions that need to be performed, such as changing at least one dust mitigation parameter. The at least one dust mitigation parameter can be turning on the dust mitigation system, supplying liquid to one or more of the valves, maintaining a timewise volume within the dust mitigation system, or a combination thereof.

The controller 202, including a human-machine interface or an operator interface (hereinafter referred to as 'operator interface 208"), can include various output devices, such as screens, video displays, monitors and the like that can be used to display information, warnings, data, such as text, numbers, graphics, icons, and the like, regarding the status of the work machine 100. The operator interface 208 can be communicatively coupled to the controller 202. The controller 202, including the operator interface 208, can additionally include a plurality of input interfaces for receiving information and command signals from various switches and sensors associated with the work machine 100 and a plurality of output interfaces for sending control signals to various actuators associated with the work machine 100. Suitably programmed, the controller 202 can serve many additional similar or wholly disparate functions as is well-known in the art.

In examples, the work machine control system 200 can include a slope and grade system 222. The slope and grade system 222 can be configured to maintain a milling depth of the work machine 100 (FIG. 1). The slope and grade system 222 can communicate with the controller 202.

With regard to input, the controller 202 can receive signals or data from the operator interface 208 (such as at the control panel 122 of FIG. 1), the slope and grade system 222, one or more sensors of the work machine 100, and the like. For example, the controller 202 can receive signals from a depth measurement sensor that can be configured to measure a milling depth of the work machine. As can be seen in the example illustrated in FIG. 2, the controller 202 can receive signals from the operator interface 208. Such signals received by the controller 202 from the operator interface 208 can include, but are not limited to, an on command for a dust mitigation system 220, a change of a parameter of the dust mitigation system 220, or an off command for the dust mitigation system 220.

The dust mitigation system 220 can be installed on a work machine (e.g., the work machine 100 of FIG. 1). The dust mitigation system 220 can be configured to mitigate dust on and around the work machine. The dust mitigation system 220 can include a controller 230, a liquid storage tank, and a dust mitigation module. The dust mitigation system 220 can communicate with the dust mitigation module to control a timewise volume, or flow rate, of liquid in the dust mitigation system 220. The dust mitigation system 220 can also include a plurality of control valves around the work machine. The dust mitigation system 220 can communicate with the dust mitigation module to fluidically connect any of the dust mitigation valves (e.g., the dust mitigation valve 132) with the liquid in the liquid storage tank (e.g., the liquid storage tank 134) to mitigate dust around the dust mitigation valves.

In other examples, such information can be provided by the dust mitigation system 220, a hydraulic system controller or the like, to the controller 202. The operation status received can include whether the work machine 100 is in non-milling operational status or milling operational status (e.g., the milling rotor 112 is not spinning, the milling rotor 112 is spinning, the work machine is moving, the milling rotor 112 is lowered below the grade of a roadway, or the like). Moreover, the operation status can include whether the dust mitigation system 220 is in operation or if the dust mitigation system 220 is in standby mode. Further, the operation status can include operational information about the dust mitigation system 220, more specifically, the dust mitigation system 220 can provide information as to the status of each dust mitigation valve 132, the pressure of the liquid within the dust mitigation system 220, the level of the liquid within the liquid storage tank 134, or the like.

In examples, the dust mitigation system 220 can receive and process data from the operator interface 208 related to the operator's desired dust mitigation levels, valve control, water pressure, and the like. The dust mitigation system 220 can also receive dust mitigation parameters, for example, timewise volume of liquid being dispensed, status of each dust mitigation valve 132, liquid level in the liquid storage tank 134, or any other parameter used in milling operations. In an example, the operator interface 208 can be configured such as to receive an input indicative of the target dust mitigation level. The target dust mitigation level can be indicative of preferred dust mitigation around the work machine 100. In another example, the target dust mitigation level can be selectable from a plurality of preset dust mitigation levels. In yet another example, the plurality of preset dust mitigation levels can be stored in a memory of the dust mitigation system 220 and can be selectable by the operator interface 208.

In examples, the dust mitigation system 220 can use the dust mitigation parameters, and the signals received from various other sensors (e.g., the sensor 130, or the like), to maintain a dust mitigation received from the operator interface 208. The dust mitigation system 220 can maintain the dust mitigation received from the operator interface 208, giving the operator of the work machine 100 one less system to control while operating the work machine 100.

In some examples, the operator of the work machine can set a desired dust mitigation level. The desired dust mitigation level can set an amount of water in the dust mitigation system 220. For example, the dust mitigation level can set a timewise volume, flow rate, or any other measurement of water in the dust mitigation system 220. For example, the controller 230 of the dust mitigation system 220 can receive a milling depth and a machine speed from the slope and grade system 222 or the controller 202. The controller 230 of the dust mitigation system 220 can determine, with a width of material being milled a known constant, a volume of material removed over time by the milling depth and the machine speed. In another example, the dust mitigation system 220 can receive a signal that is indicative of a measure of weight of material removed. The dust mitigation system 220 can then convert the measurement of weight of material removed to a volumetric rate of material removed by using an estimated or measured density of the material and knowing the amount of time that the milling machine has been operating. In an example, the controller 202 can determine a flow rate of liquid in the dust mitigation system 220 based on the target dust mitigation level and the volume of material removed over time. In an example, the target dust mitigation level can be a ratio of the timewise volume of liquid in the dust mitigation system 220 and the volume of material removed over time.

The slope and grade system 222 can send a signal (e.g., a milling depth, any other parameter communicated to the slope and grade system 222, or the like) to the dust mitigation system 220 indicative of a change to the removal rate of material being removed by the work machine 100 over time. Here, the dust mitigation system 220 can change the flow rate or pressure of water (or other liquid) in the dust mitigation system 220 accordingly to maintain the ratio of a flow rate of water in the dust mitigation system 220 to a removal rate of material being removed by work machine 100 over time equal to the selected dust mitigation level. Therefore, the controller 230 can adjust the water flow rate or pressure within the dust mitigation system 220 based on a change in machine speed or milling depth (from the slope and grade system 222), or a change in a selected dust mitigation level (from the operator interface 208).

In some examples, the work machine 100 can also include an operator interface (e.g., operator interface 208) attached to the frame 102 of the work machine 100, the operator interface 208 can be configured to communicate with an operator of the work machine 100. In some examples, the target dust mitigation level can be selectable from a plurality of preset dust mitigation levels 232. In some examples, the plurality of preset dust mitigation levels 232 can be stored in a memory of the dust mitigation system and can be selectable by the operator interface. Each of the plurality of preset dust mitigation levels 232 can be a dust mitigation level for a pre-determined milling depth or a pre-determined machine speed. In some examples, the operator may select one of the plurality of preset dust mitigation levels 232 for a planned operation of the work machine 100, and the dust mitigation system 220 maintains a predetermined liquid flow rate in the dust mitigation system 220 for the selected preset dust mitigation level and the rate of material removed over time by the work machine 100. In the example shown in FIG. 2, the dust mitigation system 220 can have a controller 230. In another example, the dust mitigation system 220 can be controlled by the controller 202 of the control system 200.

In some examples, the plurality of preset dust mitigation levels 232 can be adjustable by the operator interface 208 within a predetermined operational range. Here, the operational range can be a minimum amount of water required to maintain a minimum level of dust mitigation for the current milling parameters. In another example, the operation range can be a maximum amount of water allowed to be used in the dust mitigation system for the current milling parameters. A minimum level of dust mitigation level can be set to maintain operator comfort at reduced water and additive consumption, while still achieving proper bit lubrication and cooling, and the maximum level of dust mitigation level can be set to maximize the minimize dust levels. In some examples, the plurality of preset dust mitigation levels 132 can be input from the operator interface and saved in a memory of the dust mitigation system 220. In some examples, the plurality of preset dust mitigation levels can be recallable on the operator interface 208.

INDUSTRIAL APPLICABILITY

In an operable example, a work machine can include a method of dust mitigation for speed and depth applications of the work machine.

Figure 3:
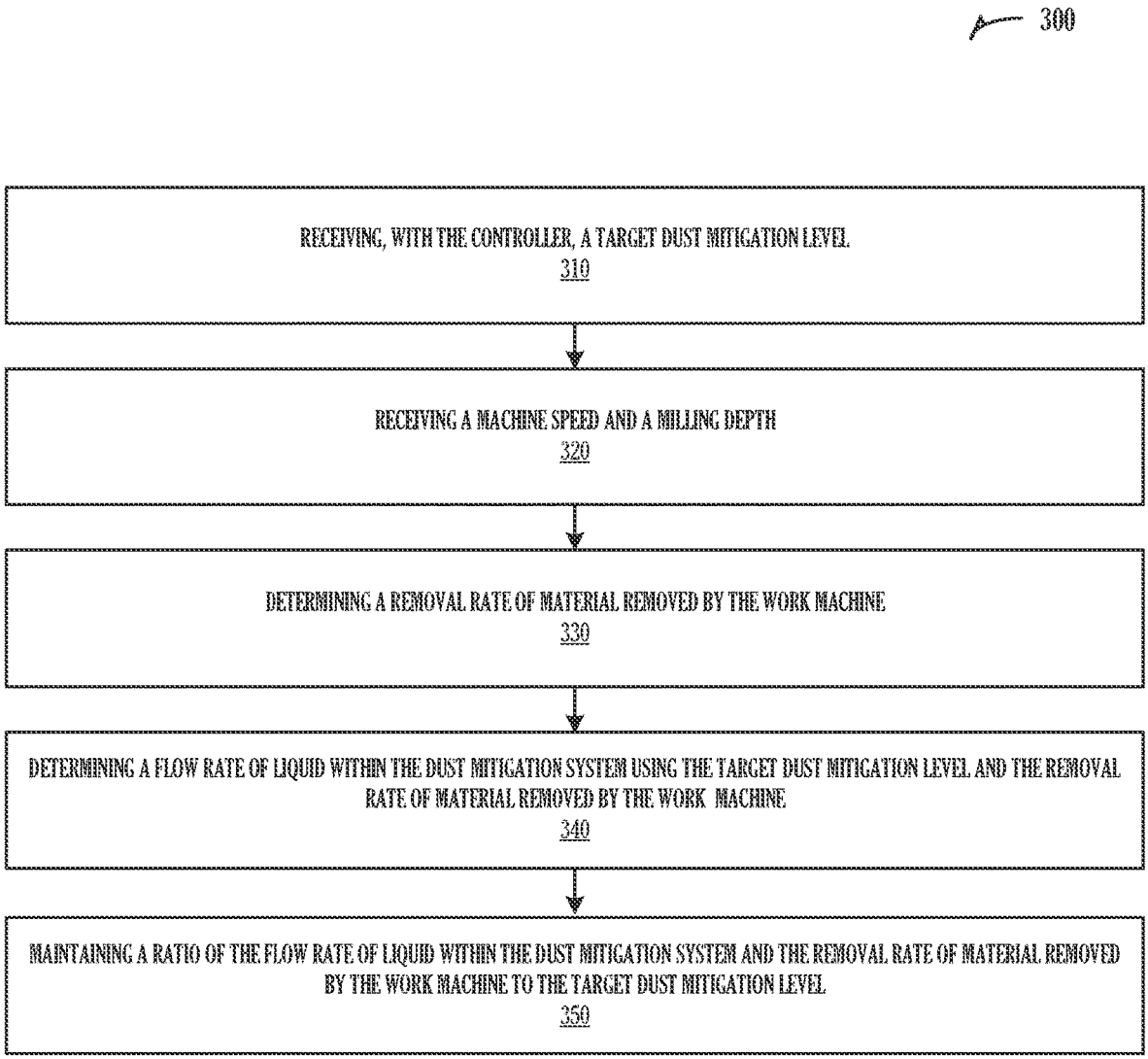
FIG. 3 is a schematic flowchart of a method of an automatic liquid spray system for dust mitigation.

FIG. 3 is a flowchart that describes a method 300 for dust mitigation for speed and depth applications. In examples, the method 300 can include an operation 310. At operation 310, the method 300 can include receiving, with the controller (e.g., the controller 202 or the controller 230 from FIG. 2), a dust mitigation level. In examples, a dust mitigation level can be requested from an operator interface (e.g., the operator interface 208). Here, the request can be to run a dust mitigation program that includes preset volume rate levels for predetermined milling depths and speeds of the work machine. In another example, the request can be set by the operator, to the operator's preferences for the predicted operations of the work machine.

At operation 320, the method 300 can include receiving a machine speed and a milling depth. In an example, the speed and milling depth can be received from a slope and grade system (e.g., the slope and grade system 222 from FIG. 2). In another example, the speed and milling depth can be received from one or more sensors installed around the work machine.

At operation 330, the method 300 can include determining a removal rate of material removed over time by the work machine. For example, the controller (e.g., the controller 202 or the controller 230) can calculate a removal rate of material removed over time by the work machine. The controller can calculate a timewise volume of material removed by knowing the milling width, depth, and rate and can use that to estimate a material removal rate. In another example, one or more image sensors can be installed with a field of view that includes at least a portion of the milling chamber. The one or more image sensors can be used to estimate an amount of material in the milling chamber over time. In another example, sensors can be installed to measure a tonnage of removed material. The controller can then convert the tonnage of material being removed to an estimated volume using an assumed or measured density of the material being removed.

At operation 340, the method 300 can include determining a flow rate of liquid within the dust mitigation system over time using the target dust mitigation level and the removal rate of material removed by the work machine over time. Here, the dust mitigation level can be a ratio over time of the flow rate of water in the dust mitigation system and a removal rate of material removed by the work machine. Thus, the controller can calculate the flow rate required within the dust mitigation system by multiplying the dust mitigation level and the volume of material being removed by the work machine. In examples, the volume of material calculated by the measured tonnage can also be used in a ratio to determine a flow rate of water required to mitigate the dust to the desired dust mitigation levels.

At operation 350, the method 300 can include maintaining a timewise ratio of the flow rate of liquid within the dust mitigation system and the removal rate of material removed to the target dust mitigation level. For example, the slope and grade machine (e.g., the slope and grade system 222) can send a signal to the dust mitigation system (e.g., dust mitigation system 220) indicative of a change to the milling depth of the work machine (e.g., the work machine 100). Here, the dust mitigation system can change the volumetric flow rate of water in the dust mitigation system when a milling depth of the work machine increases or decreases, respectively. In another example, the controller can send a signal indicative of a change in a speed of the work machine. Here, the dust mitigation system can change the volume flow rate of water in the dust mitigation system 220 when the speed of the work machine increases or decreases, respectively, to maintain the selected dust mitigation level.

The above-detailed description is intended to be illustrative and not restrictive. The scope of the disclosure should, therefore, be determined with references to the appended claims, along with the full scope of equivalents to which such claims are entitled.

What is claimed is:

1. A work machine for roadwork, the work machine comprising:
- a frame;
- a power source;
- a milling rotor operatively connected to the power source and the frame; and
- a dust mitigation system having a controller, the controller configured to:
  - receive a milling parameter of the work machine;
  - determine, based on the milling parameter, a timewise volume of material removal;
  - determine, based on a target dust mitigation level and the timewise volume of material removal, a timewise volume of liquid for the dust mitigation system, the target dust mitigation level indicative of a dust mitigation ratio of the timewise volume of liquid and the timewise volume of material removal; and
  - control, based on the dust mitigation ratio and the timewise volume of material removal, the timewise volume of liquid to satisfy the dust mitigation ratio.

2. The work machine of claim 1, further comprising:
- an operator interface attached to the frame of the work machine, the operator interface communicatively coupled to the controller.

3. The work machine of claim 2, wherein the operator interface is configured to receive an input indicative of the target dust mitigation level, and wherein the target dust mitigation level is indicative of a preferred dust mitigation around the work machine.

4. The work machine of claim 2, wherein the target dust mitigation level is selectable from a plurality of preset dust mitigation levels.

5. The work machine of claim 4, wherein the plurality of preset dust mitigation levels is stored in a memory of the dust mitigation system and are selectable by the operator interface.

6. The work machine of claim 5, wherein the plurality of preset dust mitigation levels is adjustable by the operator interface within a predetermined operational range.

7. The work machine of claim 4, wherein the plurality of preset dust mitigation levels is input from the operator interface and saved in a memory of the dust mitigation system, and wherein the plurality of preset dust mitigation levels are recallable on the operator interface.

8. The work machine of claim 1, wherein the liquid is water.

9. The work machine of claim 1, wherein the liquid is water and detergent.

10. The work machine of claim 1, wherein the work machine includes one or more dust mitigation valves, each of the one or more dust mitigation valves communicatively connected to the controller of the dust mitigation system.

11. The work machine of claim 10, wherein the controller of the dust mitigation system controls each of the one or more dust mitigation valves to change a resistance to flow through each of the one or more dust mitigation valves, respectively.

12. A method of dust mitigation for depth and speed applications of a work machine, the work machine including a frame, a power source, a milling rotor operatively connected to the power source and the frame, and a dust mitigation system having a controller, the method comprising:

receiving, with the controller, a milling parameter of the work machine;

determining based on the milling parameter, a timewise volume of material removal;

receiving, with the controller, a target dust mitigation level including a dust mitigation ratio of a timewise volume of liquid and the timewise volume of material removal;

determining, based on the ratio and the timewise volume of material removal, a flow rate of liquid to satisfy the timewise volume of liquid; and maintaining the flow rate of liquid, based on the dust mitigation ratio and the removal rate of material removed, to satisfy the target dust mitigation level.

13. The method of claim 12, where the controller of the dust mitigation system receives the target dust mitigation level from an operator interface of the work machine.

14. The method of claim 13, wherein the controller of the dust mitigation system receives a milling depth and a machine speed from a slope and grade sensor to determine the timewise volume of material removed by the work machine.

15. The method of claim 12, wherein the target dust mitigation level comprises a plurality of predetermined presets, and wherein each of the plurality of predetermined presets determines the ratio of the timewise volume of liquid within the dust mitigation system and the timewise volume of material removed.

16. The method of claim 15, further comprising:

receiving, with the controller, a selected predetermined preset from one of the plurality of predetermined presets from an operator interface to operate the dust mitigation system at the selected predetermined preset; and maintaining the ratio of the timewise volume of liquid within the dust mitigation system and the timewise volume of material removed of the selected predetermined preset.

17. The method of claim 16, further comprising:

receiving, with the controller, an adjustment to the selected predetermined preset;

adjusting the selected predetermined preset between a minimum threshold value and a maximum threshold value to generate a new predetermined preset; and storing the new predetermined preset on a memory of the dust mitigation system.

* * * * *